US005700962A

United States Patent [19]

Carden

[11] Patent Number: 5,700,962

[45] Date of Patent: Dec. 23, 1997

[54] METAL MATRIX COMPOSITIONS FOR NEUTRON SHIELDING APPLICATIONS

[75] Inventor: Robin A. Carden, Costa Mesa, Calif.

[73] Assignee: Alyn Corporation, Irvine, Calif.

[21] Appl. No.: 674,209

[22] Filed: Jul. 1, 1996

[51] Int. Cl.[6] ..... B22F 1/00

[52] U.S. Cl. ..... 75/236; 419/14; 376/288; 376/339; 252/478

[58] Field of Search ..... 252/478; 376/288, 376/339; 75/236; 419/14

[56] References Cited

U.S. PATENT DOCUMENTS

| | | |
|---|---|---|
| 4,605,440 | 8/1986 | Halverson et al. . |
| 4,644,171 | 2/1987 | Mollon . |
| 4,751,021 | 6/1988 | Mollon et al. . |
| 5,156,804 | 10/1992 | Halverson et al. . |
| 5,333,156 | 7/1994 | Lemercier . |

FOREIGN PATENT DOCUMENTS

| | | |
|---|---|---|
| 2086429 | 5/1982 | United Kingdom . |
| 2157316 | 10/1985 | United Kingdom . |

*Primary Examiner*—Charles T. Jordan
*Assistant Examiner*—Anthony R. Chi
*Attorney, Agent, or Firm*—Cooper & Dunham LLP

[57] ABSTRACT

A neutron shield is formed of a boron carbide-metal matrix composite having a density ranging from 2.5 to 2.8 g/cm$^3$ and a composition ranging from approximately 10 to 60 weight % of boron carbide and 40 to 90 weight % of metal matrix. The metal matrix is aluminum, magnesium, titanium, or gadolinium or one of their alloys. The boron carbide includes one or more metal elements added to improve the chelating properties of the metal matrix material by forming intermetallic bonds with the metal matrix material. The metal additives are present in the composite in an amount less than approximately 6% by weight. The shield may be in container or plate form.

14 Claims, 2 Drawing Sheets

METAL MATRIX COMPOSITIONS FOR NEUTRON SHIELDING APPLICATIONS

BACKGROUND

The present invention relates generally to materials for neutron shielding. More particularly, the present invention relates to boron carbide-metal matrix composites for use in neutron shields.

Boron carbide is a ceramic material commonly used for neutron absorption in nuclear applications. Boron has a naturally occurring isotope, $B^{10}$, which is an efficient absorber of neutrons and has a neutron capture cross section of approximately 4000 barns (1 barn=$10^{-24}$ $cm^2$). Typically, $B^{10}$ constitutes approximately 20% of boron, with the remainder being $B^{11}$. Therefore, boron carbide compounds with a boron-rich stoichiometry are suitable for neutron absorbing reactions.

Although boron carbide can be compacted into fully dense bodies, structures made entirely of boron carbide generally have low fracture toughness and poor thermal shock resistance. Therefore, in order to take advantage of its neutron absorption properties, boron carbide has been encased in stainless steel tubes for use as control rods in nuclear reactor cores, boron carbide pellets have been clad with zirconium-aluminum alloys for use as a burnable poison in nuclear reactors, and low-strength boron carbide-aluminum sheets have been clad with thin aluminum alloy sheets and used to line steel canisters for housing spent nuclear fuel.

An ideal neutron shielding material would be light in weight, have high thermal conductivity, be resistant to thermal shock, be corrosion resistant, and be able to withstand moderate to high operating temperatures without suffering degradation of its properties. For structural shielding applications such as nuclear waste containers or shielding elements for nuclear submarines, the ideal material would also be manufacturable into a desired shape, have high strength, have high toughness, and not be prone to brittle fracture.

The present invention contemplates the use of a boron carbide-metal matrix composite for neutron shielding applications comprised of a metal matrix material to which is added boron carbide for neutron absorption as well as to improve mechanical properties including strength and hardness of the metal matrix material. As described hereinbelow, the metal matrix composite of the present invention is stronger, stiffer, more fracture resistant, lighter in weight, harder, has higher fatigue strength, and exhibits other significant improvements over other materials combinations presently used in neutron shielding applications. In addition, the metal matrix composite of the present invention is readily castable and extrudable into desired shapes and, within a certain range of compositions, the composite is also weldable.

A metal matrix composite material such as that contemplated by the present invention is described in U.S. Pat. No. 5,486,223, which is incorporated herein by reference.

In recent years metal matrix composites have been used more frequently than before because of improvements in stiffness, strength, and wear properties. Basic metal matrix composites are made typically with aluminum, titanium, magnesium, or alloys thereof as the metal matrix material. For neutron shielding applications, gadolinium may also be used as the metal matrix material. A selected percentage of ceramic material, within a specific range, is added to the metal matrix material to form the composite. Typical ceramic additives include boron carbide, silicon carbide, titanium diboride, titanium carbide, aluminum oxide, and silicon nitride.

Most known metal matrix composites are made by a conventional process that introduces the ceramic material into a molten metal matrix. In order for the improved properties to be realized, the molten metal generally must wet the ceramic material so that clumping of the ceramic material is minimized. Numerous schemes with varying degrees of success have been utilized to improve the dispersion of the ceramic material in the molten metal.

In metal matrix composites of silicon carbide and aluminum, the silicon carbide is thermodynamically unstable in molten aluminum and this instability leads to the formation of aluminum carbide precipitates at grain boundary interfaces and an increased concentration of silicon in the metal matrix during solidification of the melt. These occurrences are believed to have detrimental effects on the mechanical properties of the resulting composite. In addition, the formation and segregation of aluminum carbide at grain boundaries is believed to adversely affect the weldability of silicon carbide-aluminum metal matrix composites.

Recently, powder metallurgy consolidation has emerged as an alternative method for fabricating metal matrix composites, where the powders are compacted by means of hot pressing and vacuum sintering to achieve a high density ingot. By following certain pressing and sintering techniques, an ingot of 99% theoretical density can be achieved.

Boron carbide-metal matrix composites are uniquely suited as a structural neutron shielding material having superior mechanical and structural properties over other metal matrix composites. Boron carbide is the third hardest material known and acts to increase the hardness of a metal matrix composite. Boron carbide is also the lightest of ceramic materials, and therefore may be used to improve the mechanical properties of a metal matrix composite without increasing its weight.

OBJECTS AND SUMMARY OF THE INVENTION

In view of the aforementioned problems and considerations, it is an object of the present invention to provide a neutron shield comprised of a boron carbide-metal matrix composite.

It is another object of the present invention to provide a boron carbide-metal matrix composite for neutron shielding where the composite is light in weight, fracture resistant, extremely hard, and has high strength.

It is yet another object of the present invention to provide a boron carbide-metal matrix composite for neutron shielding where the composite is weldable, castable, and extrudable and therefore can be formed into desired shapes.

According to an aspect of the present invention, a neutron shield is made of a boron carbide-metal matrix composite wherein the metal matrix material is aluminum, magnesium, titanium, or gadolinium, or an alloy thereof. The composite is formed by blending dry powders of boron carbide and the metal matrix material to uniformly mix the powders, and then subjecting the powders to high pressures to transform the powders into a solid body that is then sintered to form a composite that can be extruded, cast, forged, welded, and manufactured into structures for neutron shielding. Such structures include containers for holding nuclear waste, and load-bearing plates for use in neutron shielding structures in nuclear submarines and power plants.

The boron carbide-metal matrix composites of the present invention, unlike those of other metal matrix composites, are not formed through molten processes but by dry-blending boron carbide powder with the powder of the metal matrix material to uniformly mix the powders. After the powders are sufficiently mixed, they are subjected to high pressures and heat to transform the powders into a solid ingot of a boron carbide-metal matrix composite. Such composites can be approximately 60% lighter, 30% stronger, 45% stiffer, and 50% higher in fatigue strength than any of the 7000-series aluminum alloy materials. In addition, these composites can be approximately 8% lighter, 26% stronger, 5% stiffer, and have 40% greater fatigue strength than most other metal matrix composites available. Further, boron carbide-aluminum alloy metal matrix composites can exhibit a tensile strength of about 50 to 105 kpsi, a yield strength of about 45 to 100 kpsi, and a density of about 2.5 to 2.8 g/cm$^3$. Furthermore, these composites can be approximately as hard as chromoly steel but have a density that is lower than aluminum or its alloys. Such composites are also readily extrudable, and may be extruded through a die having an insert made of titanium diboride, which exhibits a significantly longer life than conventional die inserts. Certain compositions of these composites are also readily weldable. In fact, coated boron carbide particulates, as described hereinbelow, tend to flux and move into the weld pool to create a very strong weld joint. Boron carbide has a melting temperature of about 2450° C. and is chemically inert at aluminum alloy processing temperatures. Thus, the present invention is not only highly suited for the manufacture of various-shaped neutron shield articles, but is also suited for interconnecting such articles by conventional welding processes.

DETAILED DESCRIPTION OF PREFERRED EMBODIMENTS

Figure 1:
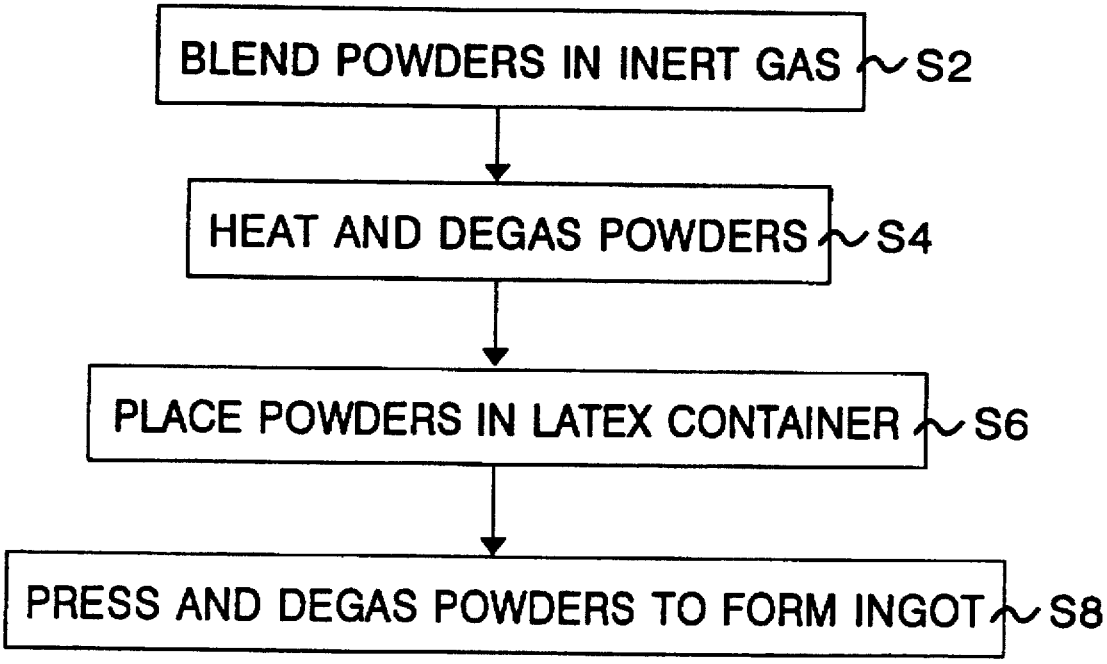
FIG. 1 is a flow chart describing a process of consolidating the powder constituents of the composite according to an embodiment of the present invention.

Preferred embodiments of the present invention are described below with reference to the accompanying drawings, in which like reference numerals represent the same or similar elements.

In an embodiment of the present invention, a neutron shielding material is formed of a boron carbide-metal matrix composite wherein the metal matrix material is aluminum or an aluminum alloy having a purity of approximately 97% when in powder form. The balance of the metal matrix material may contain trace amounts of various elements such as chromium, copper, iron, magnesium, silicon, titanium, and zinc. The boron carbide powder used in forming the composite has a purity of 99.5% and a particulate size typically in the range of 2 to 19 μm with an average particulate size of approximately 5 to 8 μm. The boron carbide can be characterized as $B_4C$ and is comprised of approximately 77% boron and 22% carbon.

The composite is formed by blending the metal matrix powder material with the boron carbide powder. Included in the boron carbide powder is approximately 0.1 to 0.4 weight % silicon, 0.05 to 0.4 weight % iron, and 0.05 to 0.4 weight % aluminum, which are added to improve the boron carbide for use in the metal matrix composite. These elements are usually present in an amount less than about 6% by weight and do not go out of solution but instead remain with the boron carbide during subsequent processing of the metal matrix composite. These additives improve the chelating properties of the metal matrix material by forming intermetallic bonds with the metal matrix material. Trace amounts of magnesium, titanium, and calcium may also be included with the additives.

Two exemplary semi-quantitative analyses of acceptable boron carbide powders for use in the present invention are shown hereinbelow in Tables I and II. However, it will be understood that the aforementioned additions of pure aluminum, silicon, and iron, may not be the only metals that can be used for the stated purpose. By way of example, virtually any low temperature metal that forms an intermetallic phase without melting the metal matrix material could be used in the present invention for the purpose indicated.

TABLE I

| | |
|---|---|
| B | 77.3% |
| Si | 0.37 |
| Mg | 0.0016 |
| Fe | 0.026 |
| Al | 0.18 |
| Cu | 0.0021 |
| Ti | 0.0088 |
| Ca | 0.0049 |
| other elements | (nil) |
| C, $O_2$ | (bal) |

TABLE II

| | |
|---|---|
| B | 77.7% |
| Si | 0.14 |
| Mg | 0.0017 |
| Fe | 0.074 |
| Al | 0.13 |
| Cu | ND 0.0002 |
| Ti | 0.017 |
| Ca | 0.0048 |
| other elements | (nil) |
| C, $O_2$ | (bal) |

As described in the flow chart of FIG. 1, after the boron carbide powder and the aluminum or aluminum alloy powder are blended together for about 2.5 hours at 20 to 30 rpm in an inert gas at step S2, the powders are degassed at 200° C. for about 1 hour in a vacuum of approximately 5 to 8 Torr at step S4 and then placed in a latex bag at step S6 and isostatically pressed at 65,000 psi. The latex bag is degassed and clamped off, and the pressure is held at this value for at least 1 minute at step S8. The resulting ingots are then removed from the bag and placed into a vacuum furnace to undergo a sintering cycle, as described immediately below.

Figure 2:
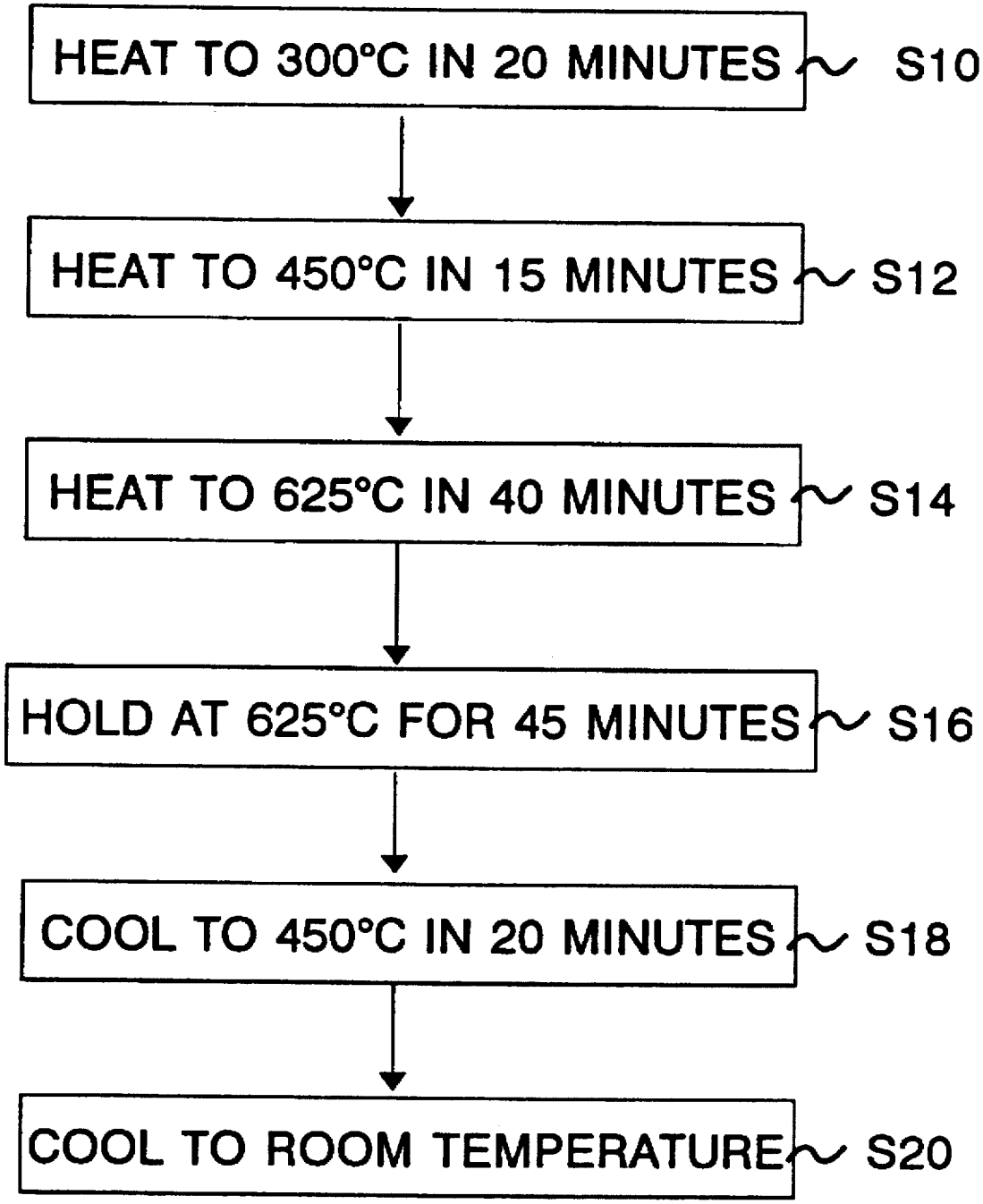
FIG. 2 is a flow chart describing a process of sintering the consolidated powders into an ingot of the metal matrix composite.

AS shown in the flow chart of FIG. 2, the ingots are heated at step S10 from room temperature to 300° C. during a 20 minute ramp period to burn off binder and water. The ingots are then heated at step S12 to 450° C. during a 15 minute ramp period to burn off any remaining binder. Subsequently, the ingots are heated at step S14 to 625° C. during a 40 minute ramp period and held at 625° C. at step S16 for 45 minutes. During this time close grain boundaries are formed. The ingot is then cooled at step S18 from 625° C. to 450° C. in 20 minutes using a nitrogen gas backfill. Finally, at step S20 the ingots are cooled to room temperature at a rate less than or equal to 40° C. per minute using nitrogen gas. The resulting boron carbide-metal matrix composite material has a density ranging from approximately 2.5 to 2.8 g/cm$^3$ depending on the type of aluminum alloy used or whether aluminum is used for the metal matrix material.

A typical relative weight contribution of the boron carbide powder and aluminum or aluminum alloy metal matrix powder is approximately 10 to 60% boron carbide and 40 to 90% metal matrix. Note that increasing the boron carbide content above approximately 30 weight % boron carbide will increase the neutron absorption efficiency of the composite but may cause degradation of the mechanical and structural properties of the composite. Several typical formulations of boron carbide-metal matrix composites according to the present invention are described below:

1. A metal matrix composite of aluminum alloy 6061 metal matrix and 20 weight % boron carbide. This composite is weldable, castable, and extrudable and exhibits a tensile strength of approximately 65 kpsi and a yield strength of approximately 60 kpsi.

2. A metal matrix composite of aluminum alloy 7091 metal matrix and 20 weight % boron carbide. This material is weldable, castable, and extrudable and exhibits a tensile strength of approximately 100 kpsi and a yield strength of approximately 90 kpsi.

3. A metal matrix composite of aluminum alloy 6061 metal matrix and 30 weight % boron carbide. This composite is castable and extrudable and exhibits a tensile strength of approximately 60 kpsi and a yield strength of approximately 60 kpsi.

4. A metal matrix composite of aluminum alloy 7091 metal matrix and 30 weight % boron carbide. This material is castable and extrudable and exhibits a tensile strength of approximately 105 kpsi and a yield strength of approximately 100 kpsi.

Extrusion of the metal matrix composites of the present invention involves preheating the ingots in a furnace for at least 1 hour at approximately 555° C. This is normally done in two steps, where the ingots are first heated to approximately 315° C. and then heated until the ingots reach 555° C. From the furnace, the ingots are then directly loaded into a chamber having a chamber temperature of preferably about 490° C. The face pressure within the chamber depends on the desired extrusion dimensions. Typically, the pressures used are approximately 15 to 20% higher than extrusion pressures used for aluminum alloy 6061 ingots. For example, a 3.5-inch diameter ingot of the metal matrix composite of the present invention can be extruded at a peak or breakout pressure of approximately 3500 psi and a steady-state extrusion pressure of approximately 3000 psi. The extrusion speed averages approximately 15 to 30 feet per minute, and the speed of the ram used for extrusion should run 3.5 inches every minute for a 3.5-inch diameter ingot.

The extruded boron carbide-aluminum alloy metal matrix composite of the present invention is preferably heat treated using a T6-type schedule, which typically includes 2 hours at 530° C., a cold water quench, and aging for 10 hours at 175° C. Preferably, all welding is done before heat treatment.

The neutron shielding composites of the present invention may be used in the fabrication of canisters used to contain spent fuel assemblies and other nuclear material. They also may be used as plates for shielding in nuclear reactor installations, such as in nuclear submarines. They also may be used in containers used to store nuclear waste.

The embodiments described above are illustrative examples of the present invention and it should not be construed that the present invention is limited to these particular embodiments. Various changes and modifications may be effected by one skilled in the art without departing from the spirit or scope of the invention as defined in the appended claims.

What is claimed is:

1. A neutron shield comprising:

a boron carbide-metal matrix composite having a composition of about 10 to 60 weight % boron carbide, about 40 to 90 weight % of a metal matrix material, and less than about 6 weight % of one or more metal additives used to improve the chelating properties of the metal matrix material by forming intermetallic bonds therewith, wherein the composite is castable, extrudable, and has a tensile strength greater than or equal to 50 kpsi and a yield strength greater than or equal to 45 kpsi, and wherein about 20% of boron in the boron carbide is a naturally occurring isotope $B^{10}$ so as to efficiently absorb neutrons.

2. A neutron shield according to claim 1, wherein the metal matrix material is selected from the group consisting of aluminum, magnesium, titanium, gadolinium, and alloys thereof.

3. A neutron shield according to claim 1, wherein the one or more metal additives are selected from the group consisting of silicon, iron, and aluminum.

4. A neutron shield according to claim 1, wherein the one or more metal additives form an intermetallic phase with the metal matrix material without melting the metal matrix material.

5. A neutron shield according to claim 1, wherein the boron carbide-metal matrix composite is formed by steps including:

blending dry powders of boron carbide and metal matrix material in a jet mill to uniformly mix the powders;

consolidating the powders by subjecting the powders to high pressures to form a compacted solid; and sintering the compacted solid at elevated temperatures to form an ingot of the composite.

6. A neutron shield according to claim 1, wherein the shield is in the form of a container.

7. A neutron shield according to claim 1, wherein the shield is in the form of a plate.

8. A material for neutron shielding comprising:

a boron carbide-aluminum alloy metal matrix composite having a composition of about 10 to 30 weight % boron carbide, about 70 to 90 weight % of a metal matrix material, and less than about 3 weight % of one or more metal additives used to improve the chelating properties of the aluminum alloy metal matrix material by forming intermetallic bonds therewith, wherein the composite is castable, extrudable, weldable and has a tensile strength greater than or equal to 50 kpsi, a yield strength greater than or equal to 45 kpsi, and a density of about 2.5 to 2.8 g/cm$^3$.

9. A castable and extrudable neutron shielding material formed by steps including:

blending dry powders of boron carbide, a metal matrix material, and one or more metal additives;

heating the blended powders;

pressing the blended powders to form a compacted solid;

vacuum degassing the blended powders and the compacted solid;

heating the compacted solid to convert the compacted solid into an ingot of the neutron shielding material that is castable and extrudable, wherein the neutron shielding material has a composition of about 10 to 60 weight % boron carbide, about 40 to 90 weight % of the metal matrix material, and less than about 6 weight % of one or more metal additives used to improve the chelating properties of the metal matrix material by forming intermetallic bonds therewith, and wherein about 20% of boron in the boron carbide is a naturally occurring isotope $B^{10}$ so as to efficiently absorb neutrons.

10. A castable and extrudable neutron shielding material according to claim 9, wherein the metal matrix material is selected from the group consisting of aluminum, magnesium, titanium, gadolinium, and alloys thereof.

11. A castable and extrudable neutron shielding material according to claim 9, wherein the one or more metal additives is selected from the group consisting of silicon, iron, and aluminum.

12. A castable and extrudable neutron shielding material according to claim 9, wherein the one or more metal additives form an intermetallic phase with the metal matrix material without melting the metal matrix material.

13. A castable and extrudable neutron shielding material according to claim 9, wherein the neutron shielding material has a composition of about 10 to 30 weight % boron carbide, about 70 to 90 weight % of an aluminum alloy metal matrix material, and less than about 3 weight % of one or more metal additives used to improve the chelating properties of the aluminum alloy metal matrix material by forming intermetallic bonds therewith, and wherein the neutron shielding material is weldable.

14. A castable and extrudable neutron shielding material according to claim 13, wherein the material has a density of about 2.5 to 2.8 $g/cm^3$.

* * * * *